US006474249B1

(12) United States Patent
Smith

(10) Patent No.: US 6,474,249 B1
(45) Date of Patent: Nov. 5, 2002

(54) MOBILE FURNACE AND METHOD OF FACILITATING REMOVAL OF MATERIAL FROM WORKPIECES

(76) Inventor: John Bruce Smith, 6712 Jefferson Ave., Falls Church, VA (US) 22042

( * ) Notice: Subject to any disclaimer, the term of this patent is extended or adjusted under 35 U.S.C. 154(b) by 0 days.

(21) Appl. No.: 09/640,704

(22) Filed: Aug. 18, 2000

(51) Int. Cl.[7] ..... F23D 5/40

(52) U.S. Cl. ..... 110/236; 110/241; 110/240

(58) Field of Search ..... 110/241, 240, 110/236; 126/343.5 A; 439/19; 134/1

(56) References Cited

U.S. PATENT DOCUMENTS

| | | | | | |
|---|---|---|---|---|---|
| 64,853 | A | | 5/1867 | Fenlason | |
| 1,962,657 | A | | 6/1934 | Hendericks | |
| 2,030,555 | A | | 2/1936 | Van Vorst et al. | |
| 2,041,359 | A | | 5/1936 | Littleford, Jr. | |
| 2,230,076 | A | | 1/1941 | Etnyre | |
| 2,554,377 | A | | 5/1951 | Ness | |
| 2,830,577 | A | | 4/1958 | Walter, Jr. | |
| 3,191,590 | A | | 6/1965 | Haley | |
| 3,271,322 | A | | 9/1966 | Stiles | |
| 3,353,004 | A | | 11/1967 | Alexander | |
| 3,518,078 | A | * | 6/1970 | Chazen | 110/236 |
| 3,598,650 | A | | 8/1971 | Lee | |
| 3,748,085 | A | * | 7/1973 | Poepsel et al. | 431/114 |
| 3,802,020 | A | * | 4/1974 | Stone et al. | 15/4 |
| 3,830,196 | A | | 8/1974 | Guttman et al. | |
| 3,834,865 | A | | 9/1974 | Lee | |
| 3,933,343 | A | | 1/1976 | Rawlings | |
| 4,090,622 | A | * | 5/1978 | Smith et al. | 214/18 K |
| 4,122,644 | A | * | 10/1978 | Woodruff | 52/787 |
| 4,133,635 | A | * | 1/1979 | Fellnor et al. | 432/19 |
| 4,141,373 | A | * | 2/1979 | Kartanson et al. | 134/21 |
| 4,246,852 | A | * | 1/1981 | Werych | 110/336 |
| 4,270,898 | A | | 6/1981 | Kelly | |
| 4,456,819 | A | | 6/1984 | Ballard | |
| 4,688,494 | A | * | 8/1987 | Domnitch | 110/240 |
| 4,738,618 | A | | 4/1988 | Massey et al. | |
| 4,739,974 | A | | 4/1988 | Mordue | |
| 4,974,528 | A | * | 12/1990 | Barcell | 110/240 |
| 5,111,756 | A | * | 5/1992 | Anderson | 110/240 |
| 5,199,212 | A | * | 4/1993 | Newcomb | 47/1.42 |
| 5,199,354 | A | * | 4/1993 | Wood | 110/241 |
| 5,205,225 | A | * | 4/1993 | Milsap | 110/240 |
| 5,238,484 | A | | 8/1993 | Pirklbauer et al. | |
| 5,575,272 | A | | 11/1996 | Byrne | |
| 6,110,430 | A | * | 9/2000 | Swisher et al. | 422/173 |

* cited by examiner

*Primary Examiner*—Ira S. Lazarus
*Assistant Examiner*—Kenneth B. Rinehart
(74) *Attorney, Agent, or Firm*—Birch, Stewart, Kolasch & Birch, LLP

(57) ABSTRACT

The mobile furnace for removing foreign material, such as coatings, from workpieces. The mobile furnace includes burners for heating a combustion chamber of the furnace, and a burner control for operating the burners. The furnace is mounted on a wheeled vehicle or the like for transport to a worksite.

23 Claims, 4 Drawing Sheets

MOBILE FURNACE AND METHOD OF FACILITATING REMOVAL OF MATERIAL FROM WORKPIECES

FIELD OF THE INVENTION

The present invention relates to a mobile furnace for facilitating the removal of foreign material, such as coatings, from workpieces, and a method of facilitating the removal of foreign material from workpieces.

BACKGROUND OF THE INVENTION

Many items, such as tools, automobile parts, fixtures, etc., have a metal structure that is combined with comparatively less durable parts or materials, such as coatings, gaskets, fiberglass, enamels, paints, etc. In general, the less durable parts or materials in such items deteriorate more quickly than the metal structures that they are combined with. Rather than discarding an item when the less durable parts or materials deteriorate, the metal structure of the item can be salvaged by removing the deteriorated material.

A conventional device for removing material from a metal structure is disclosed in U.S. Pat. No. 3,830,196 to Guttman et al. In FIG. 1, Guttman discloses a stationary painting line in which parts are hung from aluminum hangers 40, and advanced through a painting zone 20 by a conveyor 10. The painting line includes a burn-off oven 28 for removing paint that has accumulated on the aluminum hangers 40. Guttman's painting line is a static structure, and occupies a large space. In addition, workers located near the painting line may be exposed to harmful combustion products produced in the burn-off oven 28.

U.S. Pat. No. 4,270,898 to Kelly discloses a conventional burner control method for removing materials from metal parts 5 in a reclamation furnace 1. Kelly's reclamation furnace 1 is also a static structure, and the parts 5 must therefore be brought to the furnace 1 for processing. In addition, workers located near the furnace 1 may be exposed to harmful combustion products.

SUMMARY OF THE INVENTION

The present invention is in part directed to providing a mobile furnace that can be transported to a worksite for facilitating the removal of material from workpieces at the worksite. The invention is also directed to a method for facilitating the removal of foreign materials from workpieces at a worksite, using a mobile furnace.

According to one embodiment of the present invention, a mobile furnace comprises a wheeled vehicle, such as a trailer, for transporting the mobile furnace to a worksite, and burners for heating a combustion chamber to a temperature sufficient to facilitate removal of foreign material from workpieces placed in the combustion chamber. Because it is mobile, the mobile furnace does not require a fixed area for operation. The worksite can therefore be utilized for other purposes after material removal is completed.

The mobile furnace according to the present invention can also be operated at a remote worksite, so that workers and other persons are not exposed to combustion products produced during operation of the mobile furnace.

According to another embodiment of the present invention, a mobile furnace is used in a method to facilitate removal of foreign material from workpieces. In the method, workpieces are placed in the mobile furnace and heated to a temperature sufficient to remove foreign material from the workpieces (generally, the workpieces are "processed"). The burned foreign material, or ash, can be retained in the mobile furnace after removal from the workpieces, and transported to another site for disposal, or for further processing.

According to the method, the worksite receives minimal exposure to the ash produced during processing of the workpieces.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS FIGURES

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
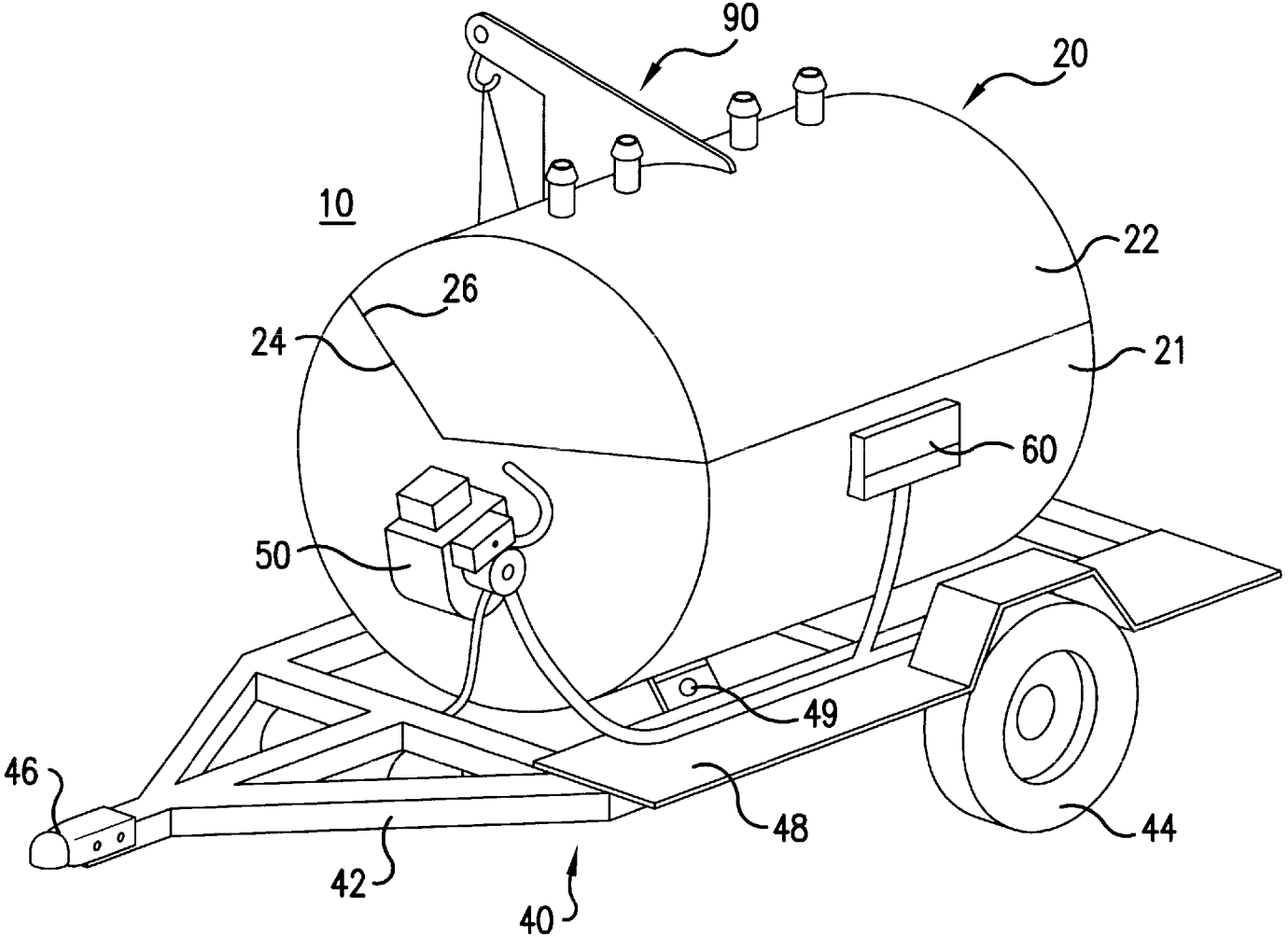
FIG. 1 is a perspective view of a mobile furnace according to one embodiment of the present invention.

FIG. 1 is a perspective view of a mobile furnace 10 according to an embodiment of the present invention. The mobile furnace 10 comprises a shell 20, two burners 50 (only one burner 50 is shown in FIG. 1), a burner control 60, an opening/closing device 90, and a trailer 40.

The shell 20 comprises a shell body 21 and a cover 22. The cover 22 may be pivotably attached to the shell body 21 by one or more hinges 23 (see FIG. 3). When the cover 22 is closed, an opening edge 24 of the cover 22 abuts with an opening edge 26 of the shell body 21 to form a generally cylindrical shell 20. The shell 20 may be made from a mild steel, such as 12 gauge mild steel, and may be formed by separating a 550 gallon oil barrel into the shell body 21 and the cover 22.

The trailer 40 comprises a frame 42 supported on wheels 44, a hitch 46, and a catwalk 48 extending along a side of the frame 42. The trailer 40 may be of a conventional design. For example, in the exemplary embodiment of FIG. 1, the trailer 40 is a ½ ton trailer. Four support members 49 (only one is visible in FIG. 1) connect the shell 20 to the trailer 40. Alternatively, wheels may be provided directly on shell 20.

Figure 2:
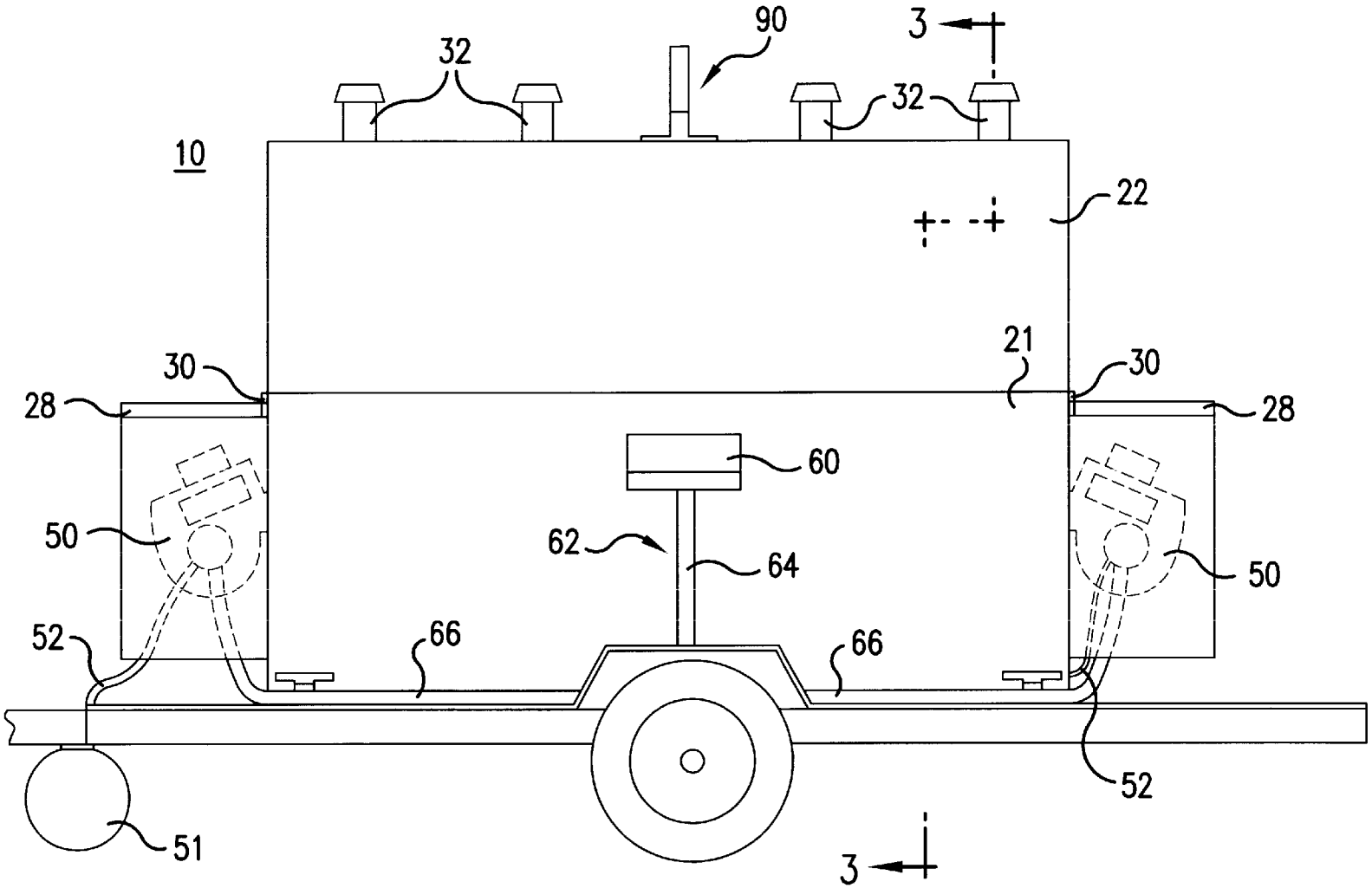
FIG. 2 is a front view of a mobile furnace according to one embodiment of the present invention.

FIG. 2 is a front view of the mobile furnace 10 shown in FIG. 1. In FIG. 2, two burner covers 28 are attached to the shell body 21, one burner cover 28 being attached to each end of the shell body 21. In FIG. 1, the mobile furnace 10 is illustrated with the burner covers 28 removed. The burner covers 28 are attached to the shell body 21 to protect the burners 50, and to prevent a person from contacting the burners 50. The burner covers 28 may be attached to the shell body 21, for example, at flanges 30 by, for example, screws, a bolt attachment, or welds.

The burners 50 (and the burner covers 28) are illustrated as being attached to each end of the shell 20, however, the burners 50 may be attached at other locations on the shell 20. The figures illustrate the mobile furnace 10 as having two burners 50, however, varying numbers of burners can be used in the mobile furnace 10. The burners 50 may be attached to the shell body 21 by, for example, a bolt attachment, screws, or welds. Each burner 50 communicates with the interior of the shell 20 via an aperture (not shown) in the end of the shell body 21 to which it is attached. The interior of the shell 20 defines a combustion chamber 34 that will be discussed later with reference to FIGS. 3 and 4.

The burners 50 may be, for example, oil burners, such as those used in residential heating systems. For example, the burners 50 may be 85,000 Btu diesel fuel burners. It is advantageous to use conventional oil burners because they burn inexpensive, easy to obtain, diesel fuel. In addition, the electrical power required to run conventional oil burners can be supplied by a standard 110V AC current source. A burner 50 requires electrical current to drive elements such as a fan, a pump, and an igniter transformer, which may all be a part of the burner 50.

The burner control 60 controls the operation of the burners 50, and is electrically connected to the burners 50 via cabling disposed within a conduit 62. The burner control 60 may have a manual ON/OFF switch for activating/deactivating the burners 50. In addition, the burner control 60 can include an electronic memory for controlling the time that the burners 50 operate, and for controlling the thermal output of the burners 50.

The AC current required to operate the burners 50 is supplied from the burner control 60 to the burners 50 via the cabling in the conduit 62. The burner control 60 can in turn be supplied with AC current from a standard 110V AC power source. The standard 110V AC power source can be external to the mobile furnace 10, such as a stationary 110V AC power outlet, or it may be on-board the mobile furnace 10, such as a mobile power generator. Other power sources can be used to supply the burner control 60, provided that the current is adjusted to be suitable for use by the burners 50.

A conduit section 64 extends downwardly from the burner control 60, and is connected to conduit sections 66. The cabling within the conduit 62 conducts current to each of the burners 50 through a respective conduit section 66. The burner control 60 controls the burners 50 by selectively opening and closing a switch, such as a relay, between the AC current supply at the burner control 60 and each burner 50.

The burner control 60 can operate the burners 50 as a function of both the time that workpieces are held in the combustion chamber 34 during operation of the burners 50, and the temperature in the combustion chamber 34. The temperature of the combustion chamber 34 is communicated to the burner control 60 from a temperature sensor 63 (see FIGS. 3 and 4) located in the combustion chamber 34. The temperature sensor 63 may be, for example, a thermocouple.

One or more exhaust pipes 32 are located on an upper surface of the cover 22, for exhausting combustion gases from the combustion chamber 34. The number and size of the exhaust pipes 32 utilized in the mobile furnace 10 is dependent upon the output of the burners 50. While four exhaust pipes 32 are shown for the purposes of illustration, a lesser or greater number of exhaust pipes 32 may be used.

Figure 3:
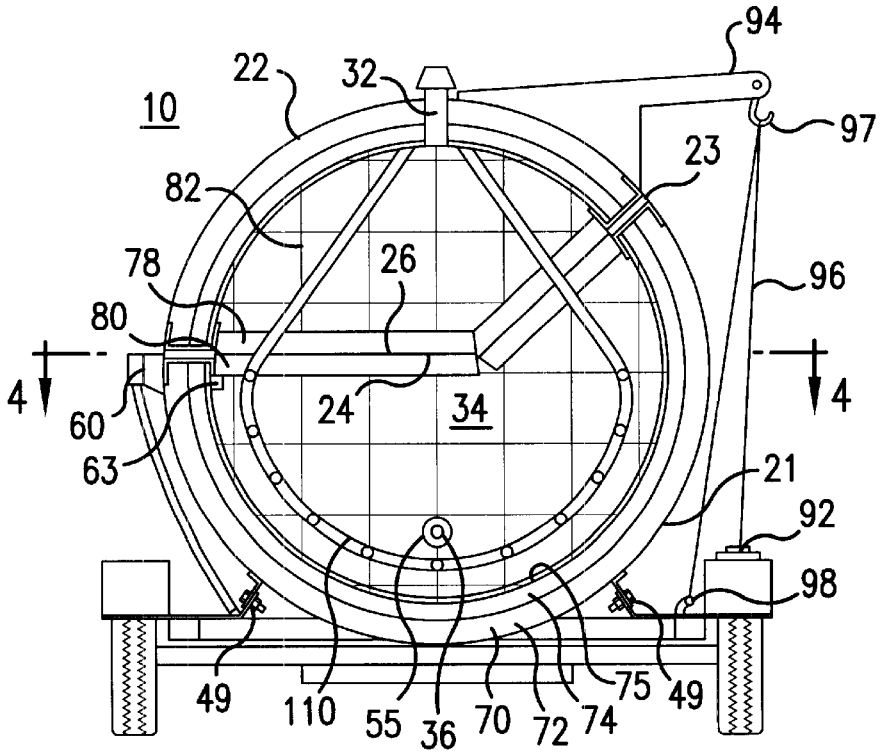
FIG. 3 is a sectional view taken along line 3—3 in FIG. 2.
Figure 4:
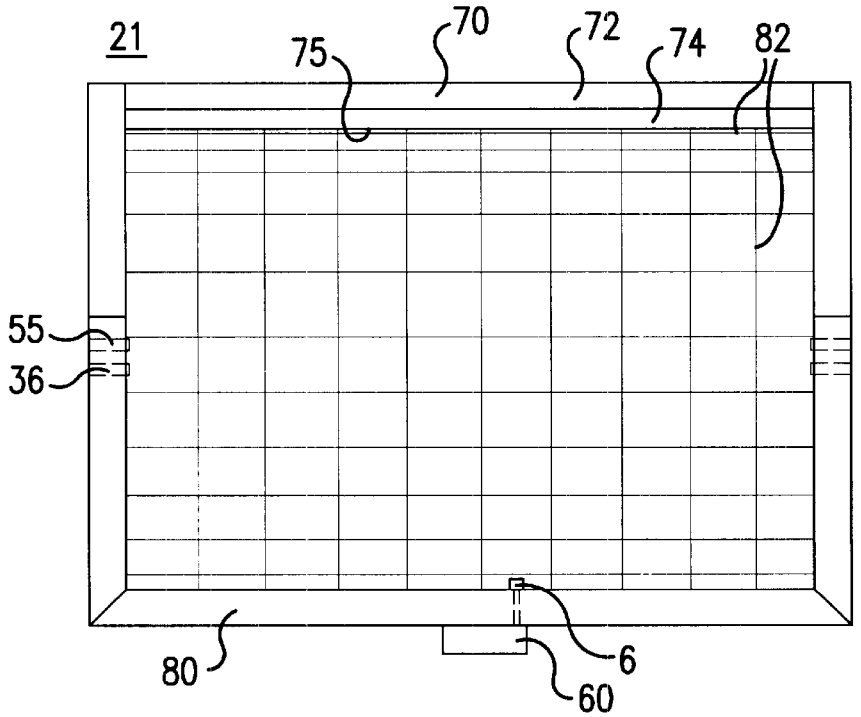
FIG. 4 is a sectional view of the shell of the mobile furnace, taken along line 4—4 in FIG. 3.

The structure of the mobile furnace will now be discussed with reference to FIGS. 3 and 4. FIG. 3 is a sectional view of the mobile furnace 10, taken along line 3—3 in FIG. 2. FIG. 4 is a sectional view of the shell body 21, taken along line 4—4 in FIG. 3.

Figure 5:
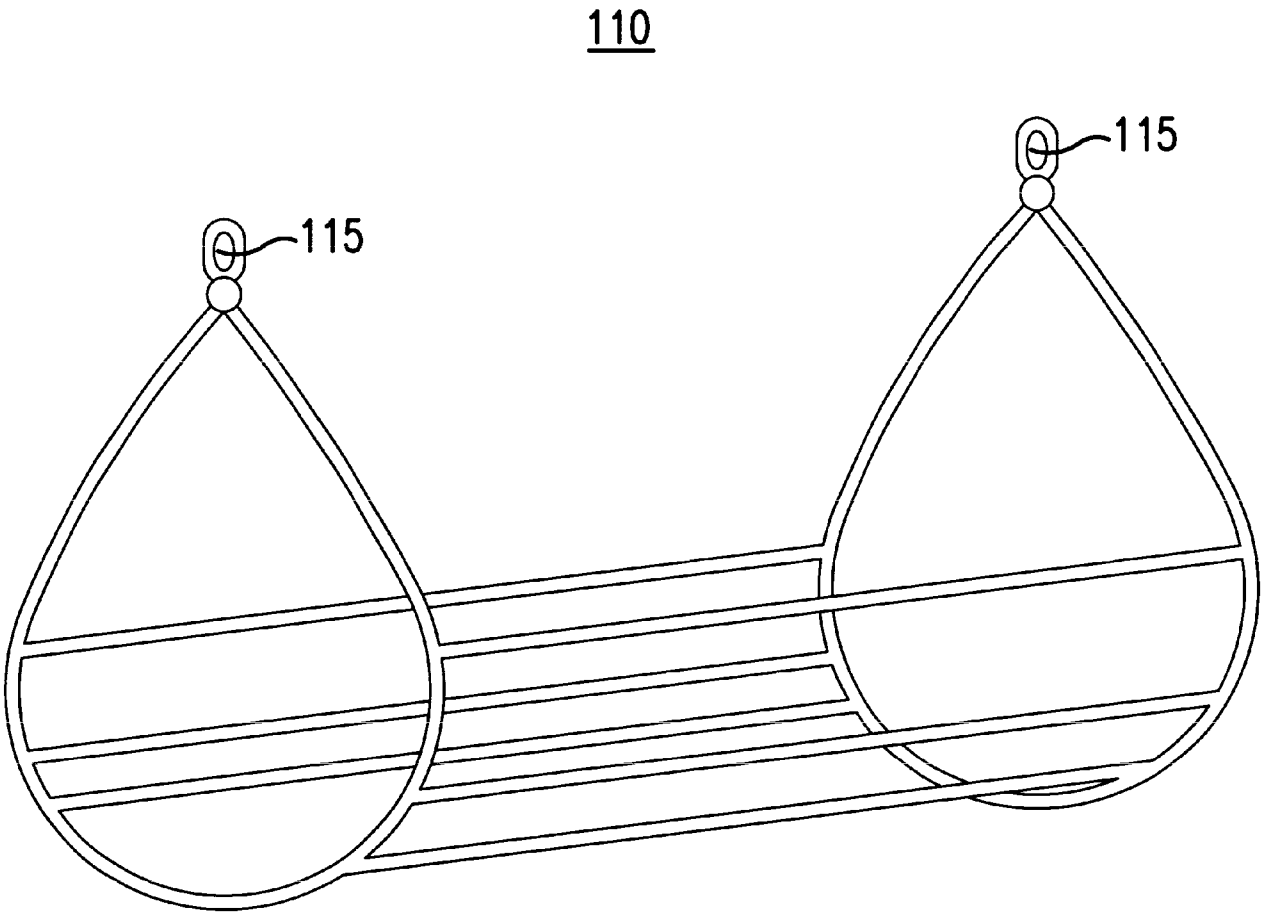
FIG. 5 is a perspective view of a process basket according to one embodiment of the present invention.

Each burner 50 includes a burner head 55 that extends, through an aperture 36, into the combustion chamber 34. A process basket 110 is provided in the combustion chamber 34 for supporting workpieces in the combustion chamber 34. The process basket 110 has support portions 115 located at either end of the process basket 110 (see FIG. 5), and each support portion 115 is pivotably supported by trunnions (not shown) located on an upper portion of the interior of the cover 22. When the cover 22 is pivoted about the hinges 23, the process basket 110 is lifted within the interior of the shell body 21, allowing easy access to workpieces supported in the process basket 110.

As an alternative to a process basket 110, workpieces can be supported in the combustion chamber 34 on a rack disposed in the shell body 21, for example, or, the workpieces can simply be placed in the bottom of the shell body 21.

Both the shell body 21 and the cover 22, which define the combustion chamber 34, are lined with insulation 70. The insulation 70 includes, for example, a first insulation layer 72, a second insulation layer 74 disposed over the first insulation layer 72, and a ceramic layer 75 disposed over the second insulation layer 74. The insulation 70 retards the escape of heat generated by the burners 50 during operation of the mobile furnace 10. The insulation 70 therefore increases the efficiency of the mobile furnace 10, because the burners 50 can burn less fuel in heating the combustion chamber 34 to a desired processing temperature.

In addition, the insulation 70 prevents the exterior of the shell 20 from becoming excessively hot during operation of the mobile furnace 10. Even when the combustion chamber 34 is at a normal processing temperature, which may exceed 1200° F., an operator usually can safely touch the exterior of the shell 20.

The insulation 70 is illustrated as comprising two layers. However, a single layer, or three or more layers of insulation may comprise the insulation 70. The first insulation layer 72 and the second insulation layer 74 may be, for example, conventional refractory blankets made from Al—O (47–48% by weight) and Si—O (51–52% by weight). Refractory blankets of this type are typically rated to withstand temperatures of up to 2,400° F.

The ceramic layer 75 may be a fritted glaze coating, which is a composite of frits and glaze. A glaze may be, for example, a silica glass, and frits may be particulate minerals, metals, or combinations thereof, which may be added to a glaze to adjust, for example, the melt characteristics of the glaze. The amount of frits added to the glaze determines the temperature at which the fritted glaze melts, and the fritted glaze used to form the ceramic layer 75 in the mobile furnace 10 is formed such that it remains solid over an expected range of processing temperatures for the combustion chamber 34. The ceramic layer 75 is rigid, and serves to protect the relatively fragile first insulation layer 72 and the second insulation layer 74 from cracking or fracture. This ceramic layer 75 is important because the first insulation layer 72 and the second insulation layer 74 may be subjected to stresses during transport of the mobile furnace 10.

The insulation 70 lining the shell body 21 is secured to the interior of the shell body 21 if necessary by a retaining grid 82. Channel 80 extends along the opening edge 26 of the shell body 21, and comprises a series of elongated metal members having generally U-shaped cross sections. The edges of the insulation 70 located near the opening edge 26 are located within the U-shaped cross sections of the channel 80. The channel 80 can be attached to the shell body 21 by welding, bolts, screws, etc.

The retaining grid 82 is a wire mesh that conforms to the shape of the combustion chamber 34. In the shell body 21, edges of the retaining grid 82 are disposed in the channel 80, along with the insulation 70. The retaining grid 82 helps to secure the insulation 70 against the interior of the shell body 21.

The insulation 70 lining the cover 22 is secured to the cover 22 if necessary by the retaining grid 82. (Channel 78 extends along the opening edge 24 of the cover 22, and edges of the insulation 70 near the opening edge 24 are disposed within the channel 78. The edges of the retaining grid 82 near the opening edge 24 are disposed in the channel 78 along with the insulation 70. The retaining grid 82 helps to secure the insulation 70 against the interior of the cover 22.

If necessary, an opening/closing device 90 is provided for opening and closing the cover 22. The opening/closing device 90 includes a winch 92 mounted on the frame 42, a lifting arm 94 mounted on the cover, and a cable 96 connected at one end to the winch 92, looped over a hook 97 suspended from the lifting arm 94, and secured to the frame 42 at an anchor 98. The winch 92 may be powered by a 100V AC power source. As an alternative to the winch 92, a manual crank can be connected to the cable 96 for opening and closing the cover 22.

The operation of the mobile furnace 10 will now be discussed.

When an operator of the mobile furnace 10 determines a worksite for removing foreign material from workpieces, the mobile furnace 10 is moved to the worksite. At the worksite, the cover 22 is raised by activating the opening/closing device 90. Workpieces are then loaded into the process basket 110 for processing, and the cover 22 is lowered by the opening/closing device 90.

Once the cover 22 is closed, the operator activates the burners 50 at the burner control panel 60. The operator can manually close a switch to provide AC power to the burners 50. Alternatively, the operator can initiate a preselected process sequence for the burners 50, the sequence being stored in a memory of the burner control 60.

Upon activation, the burners 50 propel ignited fuel into the combustion chamber 34, heating the combustion chamber 34 to a processing temperature sufficient to facilitate the removal of foreign material from workpieces in the process basket 110. The processing temperature should be high enough to facilitate removal of foreign material associated with a workpiece, but not so high as to warp or melt the workpiece. For example, a processing temperature of at least 400° F. is applicable for facilitating the removal many paints, lacquers, etc. from workpieces. A processing temperature exceeding about 700° F. is preferable because it allows for the removal of materials having higher combustion temperatures. In addition, processing workpieces at higher than 700° F. is faster than processing at lower temperatures.

When the workpieces in the combustion chamber 34 have been exposed to the processing temperature of the combustion chamber 34 for a predetermined amount of time, the burner controller 60 ceases the flow of current to the burners 50. The burners 50 then shut off, and ignited fuel is no longer supplied to the combustion chamber 34. The cover 22 is then raised, and the workpieces are removed from the process basket 110.

If present on the workpieces, ash from the burned foreign material is removed from the workpieces after the burners 50 are deactivated. The ash may be removed while the workpieces are suspended over the shell body 21, so that no ash from the workpieces is left at the worksite.

After the ash is removed from the workpieces, the parts are removed from the process basket 110. The cover 22 is then closed and the mobile furnace 10 is transported to another location for disposal of, or for further processing of, the ash produced from the processing of the workpieces. Therefore, the worksite receives minimal exposure to the ash generated by processing workpieces in the mobile furnace 10.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A mobile furnace comprising:

a shell defining a combustion chamber, the shell including a shell body and a cover pivotably mounted to the shell body;

a burner constructed and arranged to heat the combustion chamber to a temperature sufficient to facilitate removal of foreign material associated with a workpiece;

a wheel for supporting the shell so as to make the furnace mobile;

a fuel reservoir operatively connected to the burner for supplying fuel to the burner; and a support device disposed within the shell for supporting a workpiece in the combustion chamber, wherein the support device is operatively connected to an interior portion of the cover and the support device is translatable with respect to the shell body.

2. The mobile furnace of claim 1, wherein said temperature is at least 700° F.

3. A mobile furnace comprising:

a shell defining a combustion chamber, the shell including a cover mounted to the shell;

a support device operatively connected to an interior portion of the cover;

a burner constructed and arranged to heat the combustion chamber to a temperature sufficient to facilitate removal of foreign material associated with a workpiece;

a wheel for supporting the shell so as to make the furnace mobile; and insulation disposed within the shell for insulating the combustion chamber;

wherein the insulation includes a ceramic layer and the ceramic layer is a ceramic frit coating disposed over the insulation.

4. The mobile furnace of claim 3, further comprising an insulation retainer for securing the insulation within the shell.

5. The mobile furnace of claim 4, wherein the insulation retainer comprises at least one channel disposed along an axial extent of an interior surface of the shell, an edge of the insulation being located within the channel.

6. The mobile furnace of claim 4, wherein the insulation retainer comprises a retaining grid.

7. A mobile furnace comprising:

a shell defining a combustion chamber, the shell including a cover mounted to the shell;

a support device operatively connected to an interior portion of the cover;

a burner constructed and arranged to heat the combustion chamber to a temperature sufficient to facilitate removal of foreign material associated with a workpiece;

a fuel reservoir operatively connected to the burner for supplying fuel to the burner;

a wheel for supporting the shell so as to make the furnace mobile; and an opening/closing device for selectively opening and closing the cover, wherein the shell comprises a shell body and the cover pivotably mounted to the shell body.

8. The mobile furnace of claim 7, wherein the opening/closing device is a powered lifting device operatively connected to the cover and to the shell body.

9. The mobile furnace of claim 8, wherein the opening/closing device comprises a winch.

10. The mobile furnace of claim 7, wherein the shell is a cylinder.

11. The mobile furnace of claim 7, further comprising at least one exhaust device for exhausting gases from the combustion chamber.

12. The mobile furnace of claim 7, further comprising a frame, the shell being supported on the frame, and the wheel being rotatably connected to the frame.

13. A mobile furnace comprising:

a shell defining a combustion chamber;

a burner constituted and arranged for heating the combustion chamber;

insulation provided over an interior surface of the shell for insulating the combustion chamber;

an insulation retainer comprising a retainer grid and at least one channel extending along an axial length of the interior of the shell, the insulation having at least one edge disposed within the at least one channel;

a frame, the shell being supported on the frame; and a wheel for supporting the frame so as to make the furnace mobile, wherein the retainer grid is a wire grid.

14. The mobile furnace of claim 13, wherein the insulation includes a ceramic layer.

15. The mobile furnace of claim 14, wherein the insulation includes a ceramic layer.

16. The mobile furnace of claim 13, further comprising:

a fuel reservoir supported on the frame and operatively connected to the burner for supplying fuel to the burner.

17. The mobile furnace of claim 13, wherein the shell comprises:

a shell body; and a cover pivotably mounted to the shell body.

18. The mobile furnace of claim 17, further comprising a support device disposed within the shell for supporting a workpiece in the combustion chamber.

19. The mobile furnace of claim 18, wherein the support device is operatively connected to an interior portion of the cover and is translatable with respect to the shell body.

20. The mobile furnace of claim 13, further comprising an opening/closing device for selectively opening the cover.

21. The mobile furnace of claim 20, wherein the opening/closing device is a powered lifting device operatively connected to the cover and to the shell body.

22. The mobile furnace of claim 13, wherein the burner is constructed and arranged to heat the combustion chamber to at least 700° F.

23. The mobile furnace of claim 13, further comprising at least one exhaust device for exhausting gases from the combustion chamber.

* * * * *